US009213277B2

(12) United States Patent
Goda

(10) Patent No.: US 9,213,277 B2
(45) Date of Patent: Dec. 15, 2015

(54) IMAGE FORMING APPARATUS AND METHOD THEREOF

(71) Applicant: CANON KABUSHIKI KAISHA, Tokyo (JP)

(72) Inventor: Junichi Goda, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/470,133

(22) Filed: Aug. 27, 2014

(65) Prior Publication Data

US 2015/0071669 A1 Mar. 12, 2015

(30) Foreign Application Priority Data

Sep. 11, 2013 (JP) ..... 2013-188719

(51) Int. Cl.

*G03G 15/20* (2006.01)
*G03G 15/01* (2006.01)
*G03G 15/23* (2006.01)

(52) U.S. Cl.

CPC ..... *G03G 15/2039* (2013.01); *G03G 15/01* (2013.01); *G03G 15/0189* (2013.01); *G03G 15/231* (2013.01)

(58) Field of Classification Search

CPC ..... G03G 15/01; G03G 15/0189; G03G 15/2039; G03G 15/231

See application file for complete search history.

(56) References Cited

U.S. PATENT DOCUMENTS 7,196,296 B2 * 3/2007 Yamamoto ..... 219/619
7,239,816 B2 * 7/2007 Ng ..... 399/15
7,817,290 B2 * 10/2010 Klassen et al. ..... 358/1.13
2003/0219270 A1 * 11/2003 Kondo ..... 399/69
2004/0037578 A1 * 2/2004 Kurita et al. ..... 399/67
2008/0298860 A1 * 12/2008 Omata ..... 399/321
2009/0154948 A1 * 6/2009 Cahill et al. ..... 399/69
2009/0169226 A1 * 7/2009 Fujiwara ..... 399/46
2009/0196644 A1 * 8/2009 Funatsu ..... 399/69
2009/0274476 A1 * 11/2009 Nakane ..... 399/69
2010/0074642 A1 * 3/2010 Kataoka et al. ..... 399/67
2011/0286758 A1 * 11/2011 Yoshinaga ..... 399/69
2012/0027423 A1 * 2/2012 Kawai ..... 399/12
2012/0093550 A1 * 4/2012 Takemura ..... 399/329
2012/0114358 A1 * 5/2012 Sugiyama et al. ..... 399/69
2012/0114359 A1 * 5/2012 Yura et al. ..... 399/70
2013/0045021 A1 * 2/2013 Yoshioka et al. ..... 399/69
2013/0051830 A1 * 2/2013 Tamaki et al. ..... 399/69
2013/0084087 A1 * 4/2013 Ikeda ..... 399/38

(Continued)

FOREIGN PATENT DOCUMENTS

JP 11084941 A * 3/1999 ..... G03G 15/20
JP 2000-242107 A 9/2000

*Primary Examiner* — David Bolduc
(74) *Attorney, Agent, or Firm* — Fitzpatrick, Cella, Harper & Scinto

(57) ABSTRACT

To appropriately adjust a fixing temperature according to the amount of applied toner, an image forming apparatus for controlling a temperature of a fixing unit configured to fix a color material on a printing sheet, acquires a color material amount of each page of image data of a plurality of pages, determines whether a setting for printing image data of the plurality of pages on a printing sheet has been performed, determines one color material amount out of a plurality of acquired color material amounts if it is determined that the setting for printing image data of the plurality of pages on one printing sheet has been performed, and controls the temperature of the fixing unit using a fixing temperature corresponding to the determined color material amount.

8 Claims, 10 Drawing Sheets

(56) References Cited

U.S. PATENT DOCUMENTS

2013/0084092 A1* 4/2013 Ooyanagi ..... 399/69
2013/0084113 A1* 4/2013 Tamura ..... 399/335
2014/0072321 A1* 3/2014 Ooyanagi ..... 399/69
2014/0369707 A1* 12/2014 Imine ..... 399/69

* cited by examiner

IMAGE FORMING APPARATUS AND METHOD THEREOF

BACKGROUND OF THE INVENTION

1. Field of the Invention

The present invention generally relates to an image forming apparatus and a method of controlling an image forming apparatus, particularly to control of thermal fixation of a color material.

2. Description of the Related Art

There is a technique of controlling the fixing temperature of a fixing unit in accordance with the amount of applied toner obtained from image data. Japanese Patent Laid-Open No. 2000-242107 (patent literature 1) discloses a method of determining whether input image data is a photographic image or a character image, and when fixing a photographic image, making the fixing temperature of the fixing unit higher than that when fixing a character image. According to patent literature 1, the power consumption of the fixing unit can be reduced by adjusting the fixing temperature in accordance with the amount of applied toner of image data.

An image forming apparatus has a page aggregation function for saving the number of paper sheets to be output. The term "paper aggregation" means printing images of a plurality of pages on one paper sheet (also called N-in-1 or N-up printing). For example, two A4-size images are adjacently formed on an A3-size sheet, or A4-size images are reduced to ½, and images of two pages are formed on one A4-size sheet.

However, when performing page aggregation, the amount of applied toner is derived in each of the images of a plurality of pages as the subject of page aggregation. For this reason, when performing page aggregation of a plurality of pages with different amounts of applied toner, the above-described fixing temperature adjustment according to the amount of applied toner is not appropriately performed.

SUMMARY OF THE INVENTION

The present invention provides a technique capable of appropriately adjusting the fixing temperature according to the amount of a color material used.

According to one aspect of the present invention, an image forming apparatus for controlling a temperature of a fixing unit configured to fix a color material on a printing sheet, comprises: an acquisition unit configured to acquire the color material amount of each page of image data of a plurality of pages; a setting determination unit configured to determine whether a setting for printing image data of the plurality of pages on a printing sheet is performed; a one-color-material-amount determination unit configured to determine one color material amount out of a plurality of color material amounts acquired by the acquisition unit upon determining, as a result of determination of the setting determination unit, that the setting for printing image data of the plurality of pages on one printing sheet is performed; and a control unit configured to control the temperature of the fixing unit using a fixing temperature corresponding to the color material amount determined by the one-color-material-amount determination unit.

According to another aspect of the present invention, a method of controlling an image forming apparatus for controlling a temperature of a fixing unit configured to fix a color material on a printing sheet, comprises the steps of: acquiring a color material amount of each page of image data of a plurality of pages; determining whether a setting for printing image data of the plurality of pages on a printing sheet is performed; determing one color material amount out of a plurality of color material amounts acquired in the acquiring upon determining, as a result of determination in the setting determining step, that the setting for printing image data of the plurality of pages on one printing sheet is performed; and controlling the temperature of the fixing unit using a fixing temperature corresponding to the color material amount determined in the one-color-material-amount determining step.

Further features of the present invention will become apparent from the following description of exemplary embodiments (with reference to the attached drawings).

BRIEF DESCRIPTION OF THE DRAWINGS

The accompanying drawings, which are incorporated in and constitute a part of the specification, illustrate embodiments of the invention and, together with the description, serve to explain the principles of the invention.

DESCRIPTION OF THE EMBODIMENTS

Preferred embodiments of the present invention will now be described in detail with reference to the accompanying drawings. Note that the following embodiments are merely examples and are not intended to limit the technical scope of the present invention.

First Embodiment

A tandem color image forming apparatus will be exemplified below as an image forming apparatus according to the first embodiment of the present invention.

<System Configuration>

Figure 1:
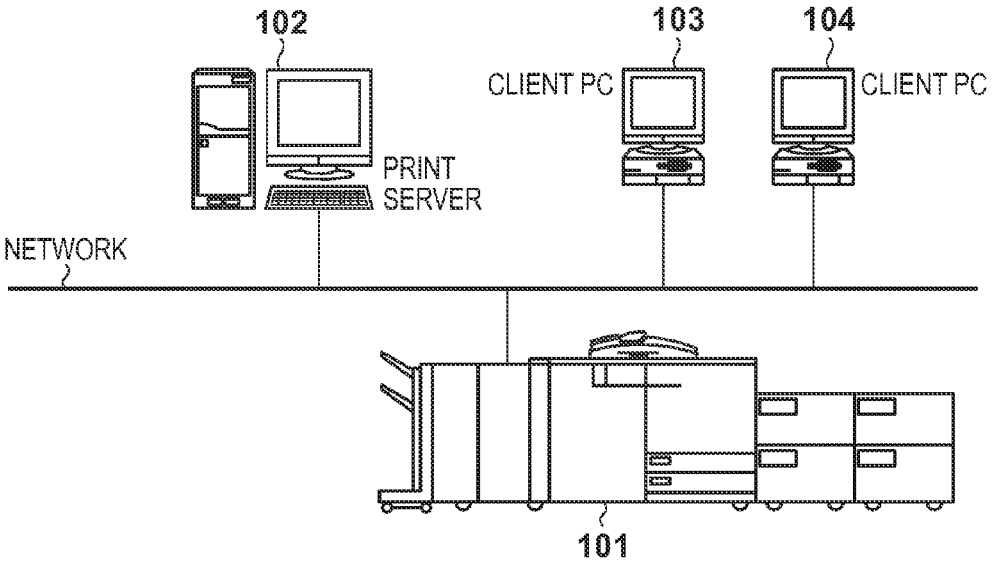
FIG. 1 is a view showing a system configuration including an image forming apparatus 101 according to the first embodiment.

FIG. 1 is a view showing a system configuration including an electrophotographic image forming apparatus 101 according to the first embodiment.

The image forming apparatus 101 processes various kinds of input data, forms images on a printing medium such as a paper sheet, and outputs a printed product. A print server 102 is connected to the image forming apparatus 101 via a network. Client PCs 103 and 104 are connected to the image forming apparatus 101 via the network, like the print server 102.

Figure 2:
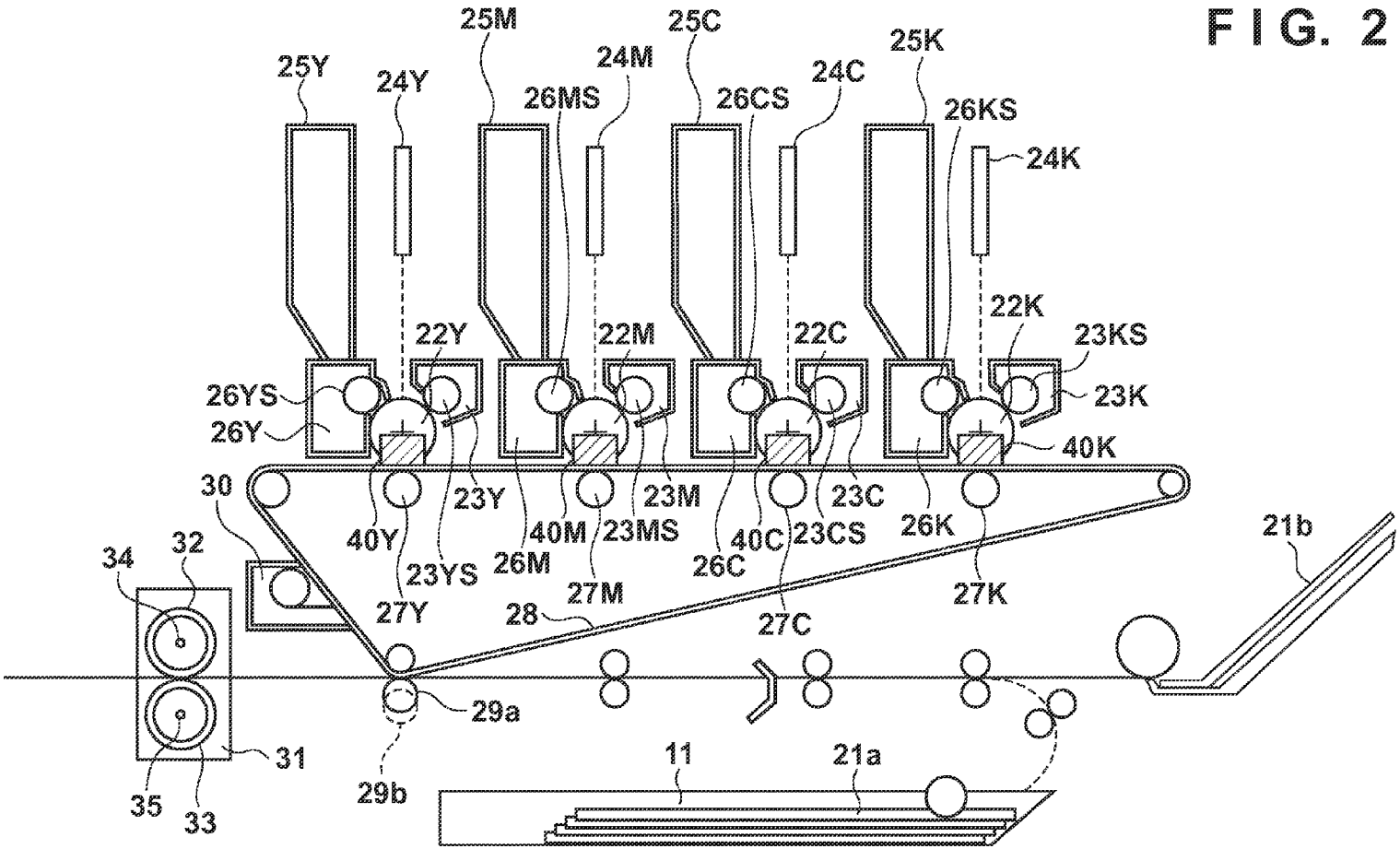
FIG. 2 is a sectional view of a tandem color image forming apparatus.

FIG. 2 is a sectional view of the tandem color image forming apparatus 101. The tandem color image forming apparatus 101 performs image formation by transferring a toner image onto a printing medium 11 via an intermediate transfer material 28. The printing medium 11 is, for example, a paper sheet or an OHP sheet.

A charging unit includes photosensitive members 22Y, 22M, 22C, and 22K, and four charge injectors 23Y, 23M, 23C, and 23K configured to charge the respective photosensitive members for yellow (Y), magenta (M), cyan (C), and black (K) toner.

The photosensitive members 22Y, 22M, 22C, and 22K rotate upon receiving driving forces transmitted from driving motors 40Y, 40M, 40C, and 40K, respectively. Referring to FIG. 2, the driving motors rotate the photosensitive members 22Y, 22M, 22C, and 22K, respectively, counterclockwise in accordance with an image forming operation.

An exposure unit irradiates the photosensitive members 22Y, 22M, 22C, and 22K with exposure light using scanner units 24Y, 24M, 24C, and 24K, respectively, and selectively exposes the surfaces of the photosensitive members 22Y, 22M, 22C, and 22K. Electrostatic latent images are thus formed on the photosensitive members.

A developing unit includes four developers 26Y, 26M, 26C, and 26K that perform development for the colors Y, M, C, and K, respectively, to visualize the electrostatic latent images on the photosensitive members. The developers are provided with sleeves 26YS, 26MS, 26CS, and 26KS, respectively. Note that the developers are detachable.

A transfer unit transfers a single-color toner image from each photosensitive member onto the intermediate transfer material 28. In FIG. 2, the intermediate transfer material 28 rotates clockwise. The single-color toner images are sequentially transferred onto the intermediate transfer material 28 as the photosensitive members 22Y, 22M, 22C, and 22K and primary transfer rollers 27Y, 27M, 27C, and 27K located on opposing sides rotate. This is called primary transfer. Note that when an appropriate bias voltage is applied to the primary transfer roller, and the photosensitive member and the intermediate transfer material 28 are caused to have different rotation speeds, the single-color toner image can efficiently be transferred onto the intermediate transfer material 28.

The transfer unit also overlays the single-color toner images on the intermediate transfer material 28, and conveys the overlaid multicolor toner image to a secondary transfer roller as the intermediate transfer material 28 rotates. In addition, the printing medium 11, such as a paper sheet, is conveyed from a paper feed tray to the secondary transfer roller in a sandwiched state, and the multicolor toner image on the intermediate transfer material 28 is transferred onto the printing medium 11. At this time, an appropriate bias voltage is applied to the secondary transfer roller, and the toner image is electrostatically transferred. This is called secondary transfer. The secondary transfer roller contacts the printing medium 11 at a position 29*a* during transfer of the multicolor toner image onto the printing medium 11, and separates to a position 29*b* after print processing.

A fixing unit is a functional unit that fuses and fixes, to the printing medium 11, the multicolor toner image transferred onto the printing medium 11. For this purpose, the fixing unit includes a fixing roller 32 that heats the printing medium 11, and a pressurizing roller 33 that presses the printing medium 11 against the fixing roller 32. The fixing roller 32 and the pressurizing roller 33 are formed to be hollow and incorporate heaters 34 and 35, respectively. A fixing device 31 causes the fixing roller 32 and the pressurizing roller 33 to convey the printing medium 11 holding the multicolor toner image, and applies heat and a pressure, thereby fixing the toner to the printing medium 11.

Note that a temperature sensor (not shown) is attached to the fixing unit, and the fixing unit is controlled to perform a fixing operation only when a temperature sufficient for fixing is confirmed. After that, the printing medium 11 after toner fixing is discharged to a discharge tray (not shown) by a discharge roller (not shown), and the image forming operation ends.

A cleaning unit 30 cleans toners remaining on the intermediate transfer material 28. Waste toners remaining after the four-color toner image formed on the intermediate transfer material 28 is transferred onto the printing medium 11 are removed from the intermediate transfer material 28 by cleaning and stored in a cleaner container.

<Arrangement of Image Forming Apparatus>

Figure 3:
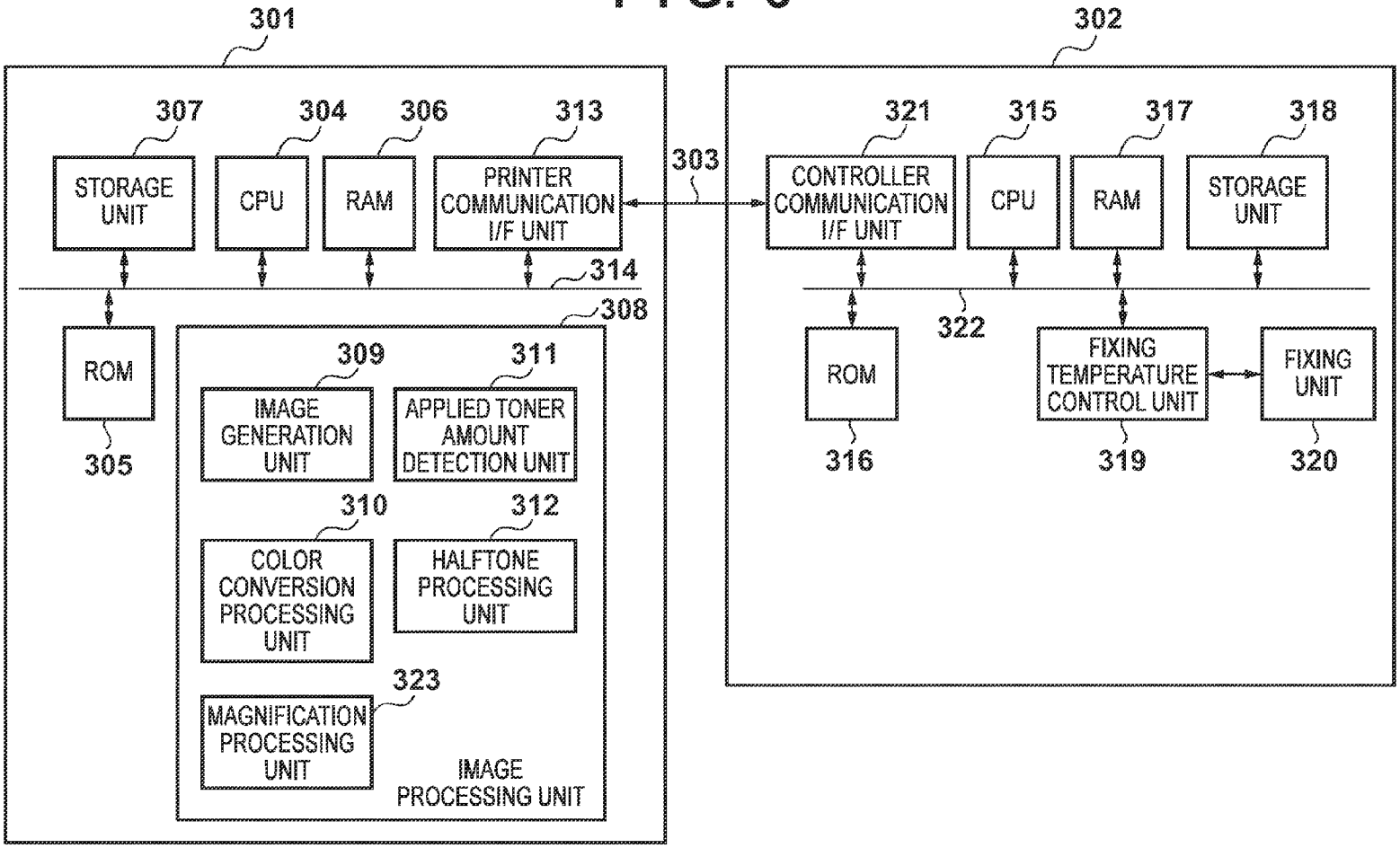
FIG. 3 is a block diagram of the arrangement of the image forming apparatus.

FIG. 3 is a block diagram of the arrangement of the image forming apparatus 101. The image forming apparatus 101 is roughly divided into a controller unit 301 and a print unit 302. The controller unit 301 is a functional unit that receives print data from an external apparatus and generates image data (raster image data) to be provided to the print unit 302. The print unit 302 is a functional unit that forms an image on a printing medium such as a paper sheet based on the image data received from the controller unit 301.

The controller unit 301 and the print unit 302 include CPUs 304 and 315 configured to execute programs, ROMs 305 and 316, and RAMs 306 and 317, respectively. Each CPU reads out a main program from the ROM and stores it in the RAM in accordance with an initial program stored in the ROM. The RAM is used to store programs or as the main memory for work. The controller unit 301 and the print unit 302 further include storage unit 307 and storage unit 318, respectively.

An image generation unit 309 generates printable raster image data based on print data (print job) received from, for example, a computer apparatus (not shown) that is an external apparatus. The raster image data includes RGB data and attribute data representing the data attribute of each pixel. The image generation unit 309 may handle image data read by a reading unit (scanner) installed in the image forming apparatus 101 itself. The reading unit here can be a CCD (Charged Couple Device) reading unit or a CIS (Contact Image Sensor) reading unit. A processing unit that performs predetermined image processing for the read image data may also be provided. The image forming apparatus 101 may be configured to receive image data from an external reading unit via an interface (not shown), instead of including the reading unit in itself.

A magnification processing unit 323 performs magnification processing of image data expressed by RGB or CMYK. A color conversion processing unit 310 converts RGB data into CMYK in accordance with the toner colors, and generates CMYK data and attribute data. At this stage, the image data represents color material amounts (for example, toner amounts) of CMYK, and is expressed by, for example, values of 0 to 255 (8-bit value) on a pixel basis. For example, if the values of all colors are "0", this represents disuse of toners. The larger the value, the higher the density. A value "255" represents the highest density.

An applied toner amount detection unit 311 detects (derives) the amount of applied toner from the CMYK data generated by the color conversion processing unit 310. A detailed applied toner amount detection method will be described later with reference to FIG. 4. The applied toner amount detection unit 311 sends the CMYK data that has undergone the applied toner amount detection and the attribute data to a halftone processing unit 312. In addition, at the time when applied toner amount detection of the processed image data has ended, the applied toner amount detection unit 311 holds the applied toner amount information of the processed image data in association with the corresponding image data. The held applied toner amount information is read out by a CPU 304. The CPU 304 calculates the minimum temperature necessary for fixing based on the readout applied toner amount information. A method of calculating the minimum temperature necessary for fixing will be described later with reference to FIG. 5.

The halftone processing unit 312 performs halftone processing for each of the CMYK data output from the applied toner amount detection unit 311. As a detailed arrangement, the halftone processing unit 312 performs screen processing or error diffusion processing. In the screen processing, N-ary processing is performed using a plurality of predetermined dither matrices and input image data. In the error diffusion processing, N-ary processing is performed by comparing input image data with a predetermined threshold, and the difference between the input image data and the threshold at that time is diffused to peripheral pixels to be subsequently subjected to N-ary processing.

A printer communication I/F unit 313 and a controller communication I/F unit 321 are I/F units configured to perform communication between the controller unit 301 and the print unit 302. Information to be communicated here includes various kinds of control signals and the minimum temperature information necessary for fixing, as well as image data (raster image data) to be printed. A fixing temperature control unit 319 controls the temperature of a fixing unit 320 based on temperature information (for the example, the minimum temperature information necessary for fixing) received from the controller unit 301.

<Applied Toner Amount Detection>

Figure 4:
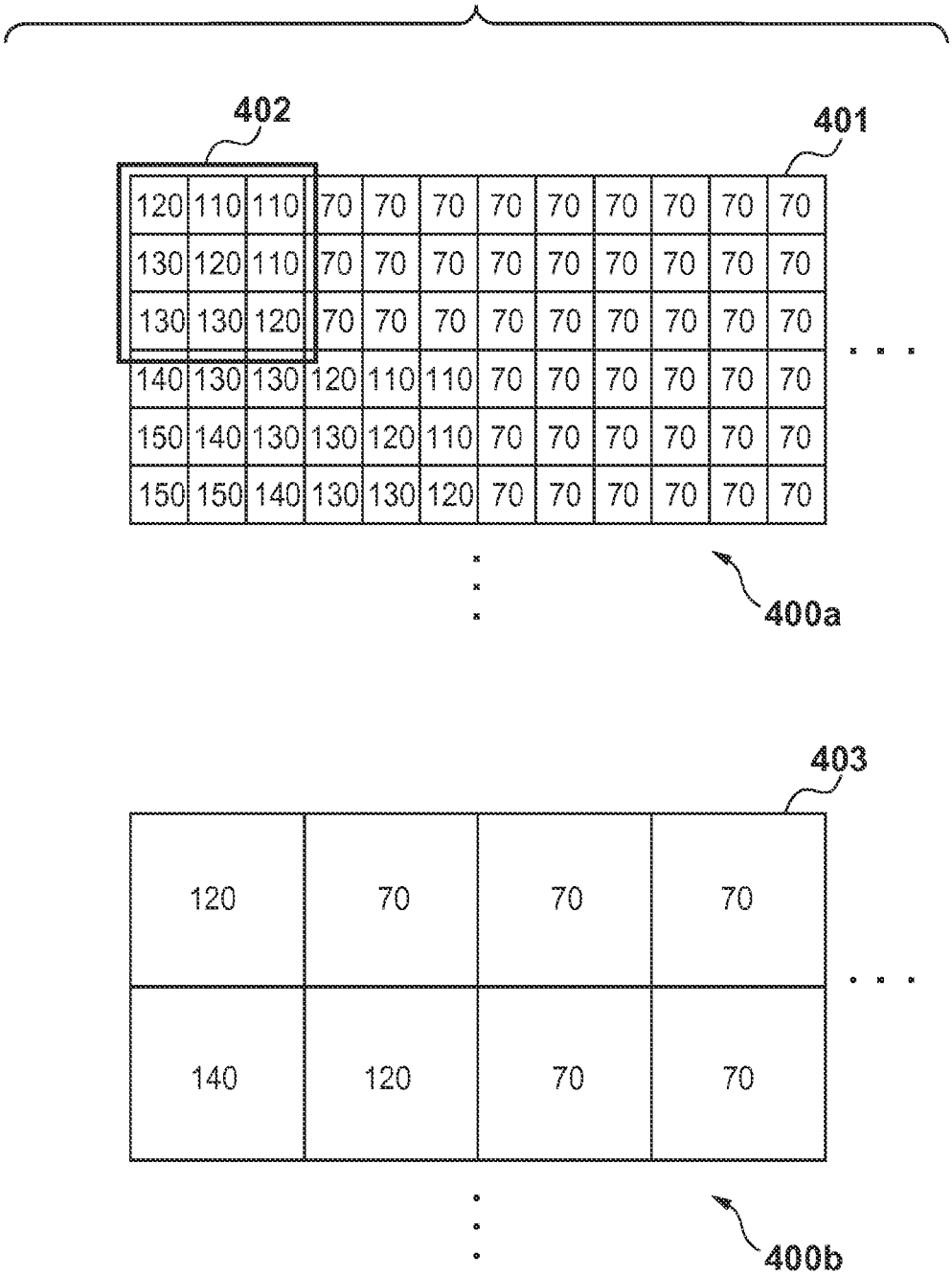
FIG. 4 is a view for illustrating the applied toner amount detection method of the image forming apparatus.

FIG. 4 is a view for illustrating the applied toner amount detection method of the image forming apparatus 101. Note that in the following explanation, the amount of applied toner is expressed as a ratio (unit: %) to the maximum value of the toner weight per unit area as 100%. For each color on a pixel basis, a value "255" corresponds to the amount of applied toner of 100%. The sum of the amounts of applied toners of CMYK represents the amount of applied toner of the pixel.

For example, when two colors each having the maximum value (100%) are overlaid, the amount of applied toner of the pixel is 200%. Note that each color has tonality and can take a value within the range of 0% to 100%. For example, in an image that makes full use of four CMYK toners in a full-color print mode, the maximum amount of applied toner is large. On the other hand, for example, in a monochrome image using K toner alone, the maximum amount of applied toner is smaller.

Upon receiving CMYK data (raster image data) generated by the color conversion processing unit 310, the applied toner amount detection unit 311 calculates the necessary amount of applied toner for each pixel. An image 400*a* represents part of image data to be processed by the applied toner amount detection unit 311. A minimum unit indicated by reference numeral 401 represents one pixel. Reference numeral 402 indicates a pixel block of 3×3 pixels. A numerical value shown in each pixel of the image 400*a* represents the amount of applied toner of the pixel detected by the applied toner amount detection unit 311.

The applied toner amount detection unit 311 calculates the average value of the amounts of applied toner in each pixel block of 3×3 pixels. The average value in each pixel block is calculated because the temperature necessary for fixing an image often depends on not the amount of applied toner of each pixel but a toner amount in a predetermined range in general. For this reason, the average value in each pixel block is calculated here. However, the minimum value and maximum value in a pixel block may be used. Note that an image 400*b* is obtained by calculating the average value of the amounts of applied toner in each pixel block of the image 400*a*. The numerical value inscribed in each pixel block represents the average value of the amounts of applied toner in the pixel block.

When calculation of the average value of the amounts of applied toner in a processed pixel block has ended, the applied toner amount detection unit 311 holds the amount of applied toner having the maximum value among all pixel blocks of the processed image data as the applied toner amount information of the target page.

<Fixing Temperature Determination Based on Amount of Applied Toner>

As described above, the amount of applied toner refers to the toner amount per unit area of an image. To fix toner on a printing medium without any fixing failure, the temperature of the fixing unit 320 needs to be set to a fixing temperature capable of reliably fixing a pixel (or pixel block) whose amount of applied toner has the maximum value in the target page. Since the maximum amount of applied toner changes depending on image data to be printed, the temperature necessary for fixing also changes depending on image data. More specifically, the larger the maximum amount of applied toner, the higher the necessary temperature.

Figure 5:
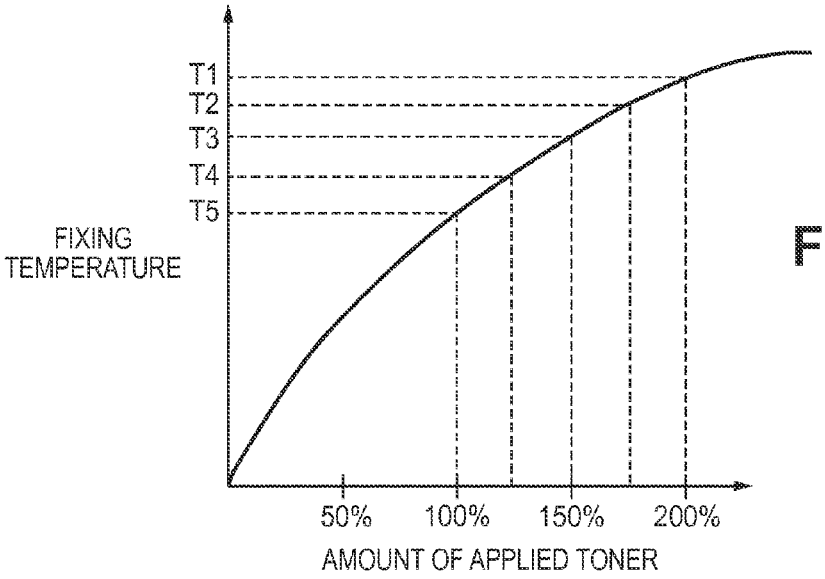
FIG. 5 is a graph showing the relationship between an amount of applied toner and a fixing temperature.

FIG. 5 is a graph showing the relationship between the amount of applied toner and the fixing temperature. The abscissa represents the amount of applied toner, and the ordinate represents the temperature necessary for fixing. For example, when the determination result of the applied toner amount detection unit 311 is 200%, the minimum temperature necessary for fixing is T1. When the detection result is 100%, the minimum temperature necessary for fixing the target page is T5, as can be seen.

If the temperature has risen to the temperature capable of fixing the maximum amount of applied toner appearing in a print page, no problem such as a fixing failure occurs in the whole image. It is therefore possible to obtain the minimum temperature necessary for fixing a page to be output based on the applied toner amount information detected by the above-described applied toner amount detection unit 311.

Note that the relationship (relationship data) shown in the graph of FIG. 5 is stored in a storage unit 307 or a RAM 306 as, for example, a lookup table (LUT) because it is used in temperature control of the fixing unit 320.

<Operation of Image Forming Apparatus>

Figure 6:
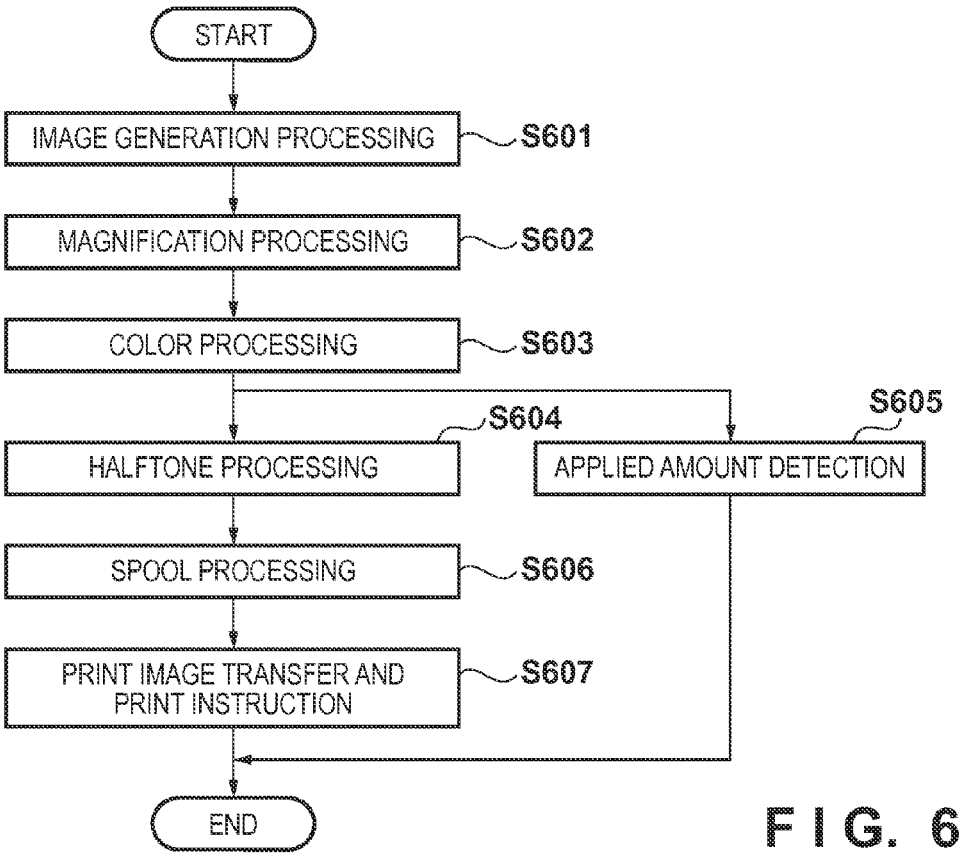
FIG. 6 is a flowchart for illustrating image processing in a controller unit.

FIG. 6 is a flowchart for explaining image processing in the controller unit 301. In particular, the processing sequence of applied toner amount detection characteristic of the first embodiment will be described. The procedure shown in FIG. 6 is implemented by causing the CPU 304 to execute a control program and operate an image processing unit 308.

In step S601, the image generation unit 309 generates raster image data from print data. As described above, RGB data and attribute data representing the data attribute of each pixel are output on a pixel basis as the raster image data.

In step S602, the magnification processing unit 323 performs magnification processing of the image as needed. The phrase "as needed" refers to the case where the image size needs to be changed, for example, the case where page aggregation is performed by N-in-1 printing that prints N (N is an integer of 2 or more) input image data on one surface of one printing medium.

In step S603, the color conversion processing unit 310 converts the RGB data into CMYK in accordance with the toner colors, and generates CMYK data and attribute data.

In step S604, the halftone processing unit 312 performs halftone processing (N-ary processing) for the CMYK data by a method using screen processing or error diffusion processing.

In step S605, the applied toner amount detection unit 311 detects the amount of applied toner based on the CMYK data. This processing may be executed in parallel to the halftone processing of step S604. Note that the applied toner amount detection is performed here because the amount of applied toner can be calculated more accurately by performing applied toner amount detection for CMYK data that is a continuous toner image than by performing applied toner amount detection for a halftone image. The amount of applied toner may be calculated from an image after halftoning, as a matter of course.

In addition, the applied toner amount detection is performed here by a method using all the YMCK colors. For this reason, if the applied toner amount detection is performed after halftone processing, the temporarily separated YMCK colors need to be collected. When performing the applied toner amount detection by hardware, hardware to read out the separated YMCK colors or a buffer configured to collect the YMCK colors is needed. To avoid this, the applied toner amount detection is performed here in step S605.

In step S606, the CPU 304 performs spool processing of temporarily storing the result of halftone processing in step S604 in the RAM 306. Note that when performing layout processing such as page aggregation, in step S606, the image data are stored in the RAM 306 in consideration of the positions of one or more images after layout. For example, when performing 4-in-1 page aggregation, the processes of steps S601 to S605 are repeated four times, and the image data are spooled on the RAM 306 in consideration of the positions of the images after layout.

In step S607, the CPU 304 transmits the image data (image data after halftone processing) to the print unit 302 via the printer communication I/F unit 313 and a communication line 303.

<Fixing Temperature Control Based on Detected Amount of Applied Toner>

Figure 7A:
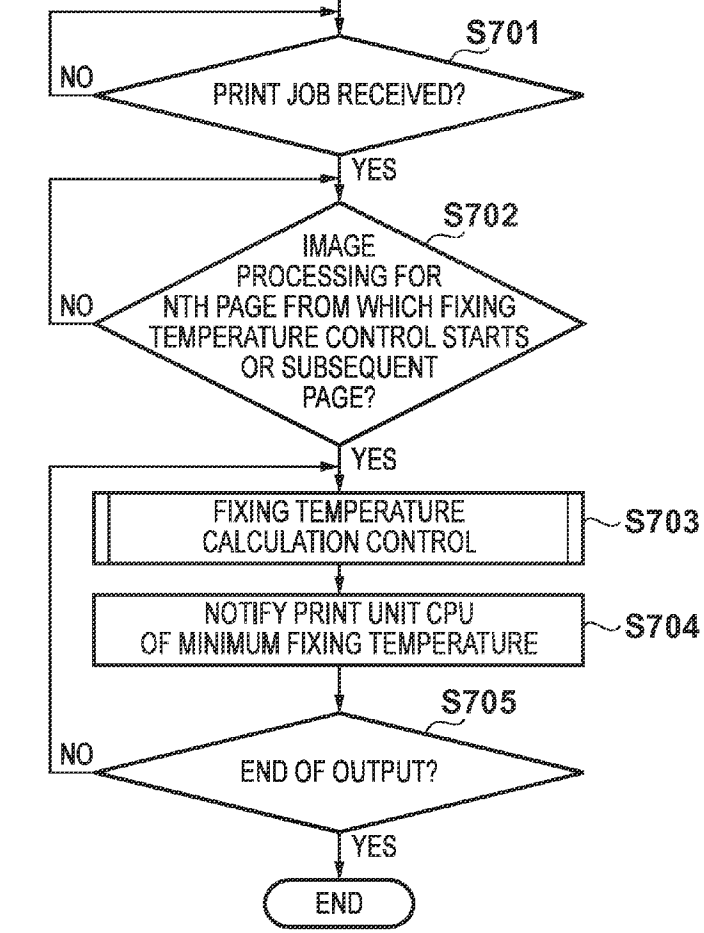
FIGS. 7A and 7B are flowcharts for illustrating fixing temperature control.
Figure 7B:
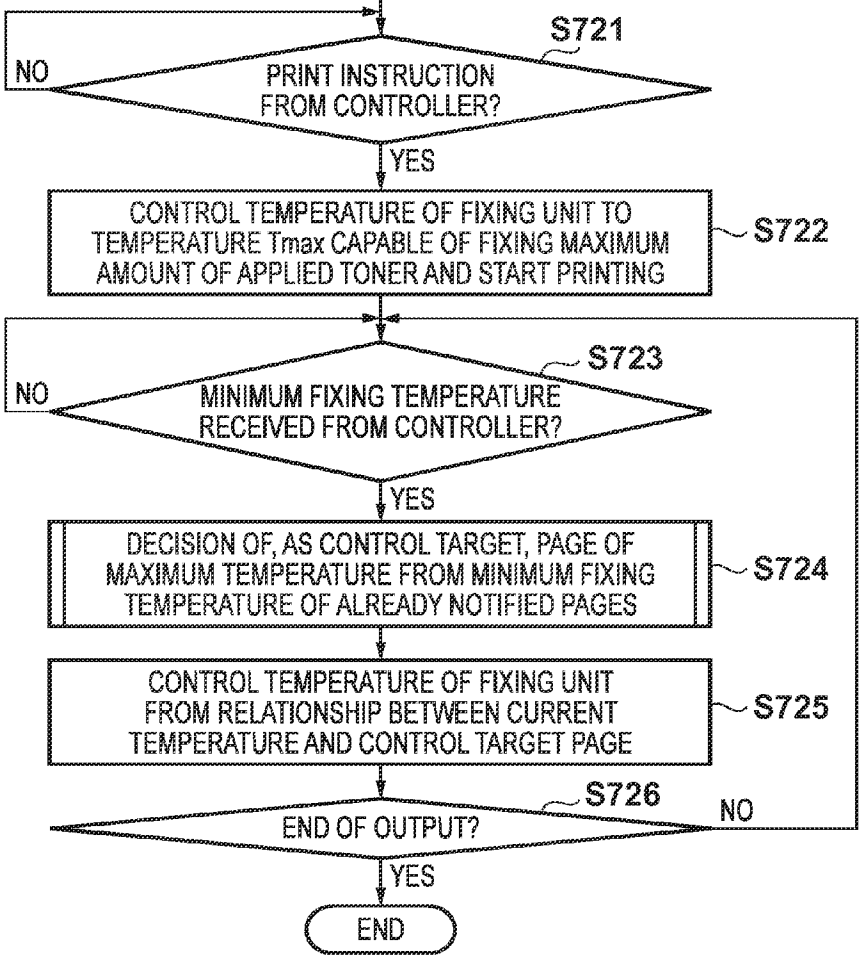

Fixing temperature control processing using an applied toner amount detection result in the image forming apparatus 101 according to the first embodiment will be described with reference to FIGS. 7A and 7B. FIG. 7A shows processing to be executed under the control of the CPU 304 of the controller unit 301. FIG. 7B shows processing to be executed under the control of a CPU 315 of the print unit 302. Note that the "page" in the description of the flowcharts refers to the ordinal number of image data corresponding to one page of a printing medium such as a paper sheet. That is, when performing layout such as page aggregation, image data after the layout is handled as one page.

First, processing to be executed under the control of the CPU 304 of the controller unit 301 will be explained with reference to FIG. 7A.

In step S701, when an external print job is input (received), the CPU 304 starts print processing. Note that the image forming apparatus 101 previously detects the amount of applied toner of a page to be fixed several pages after, and notifies the fixing unit 302 of the amount of applied toner in advance to efficiently control the temperature of the fixing unit 320 without lowering the productivity.

For the sake of simplicity, a description will be provided here assuming that the image forming apparatus 101 previously detects the amount of applied toner of the fourth page to be fixed after the page currently under fixing, and notifies the fixing unit 320 of it. Immediately after the start of printing, when the temperature of the fixing unit 320 is controlled after detecting the amount of applied toner, the image forming apparatus 101 cannot immediately react to a print instruction from the user, resulting in low productivity. To prevent this, fixing temperature control on a page basis is not performed for four pages after the start of printing, and fixing is performed at a fixing temperature capable of fixing the maximum amount of applied toner possible in the image forming apparatus 101. The fixing temperature control on a page basis is performed from the fifth image data after the start of printing.

In step S702, the CPU 304 determines whether the page as the subject of image processing is the Nth page (fifth page in this case) from which the temperature control starts or a subsequent page. When the page as the subject of image processing is fifth page from which the temperature control starts or a subsequent page in step S702, the process advances to step S703.

In step S703, the CPU 304 calculates the minimum temperature necessary for fixing the target page to be output. A detailed control procedure of step S703 will be described later with reference to FIG. 8.

In step S704, the CPU 304 notifies the CPU 315 of the print unit 302 of the minimum temperature necessary for printing the target page, which is determined in step S703, via the printer communication I/F unit 313.

In step S705, the CPU 304 determines whether a page to be output next exists. If a next page exists, processing from step S703 is repeated.

Next, processing to be executed under the control of the CPU 315 of the print unit 302 will be explained with reference to FIG. 7B.

In step S721, the CPU 315 waits for a print instruction from the controller unit 301. When a print instruction from the controller unit 301 is received, the process advances to step S722.

In step S722, the CPU 315 causes the fixing temperature control unit 319 to control the temperature of the fixing unit 320 to become a temperature Tmax capable of fixing the maximum amount of applied toner in order to print the first four pages without lowering the productivity, and starts printing.

In step S723, the CPU 315 waits for reception of data representing the minimum temperature necessary for fixing the target page from the controller unit 301. Upon receiving the data representing the fixing temperature from the controller unit 301 in step S723, the process advances to step S724. Note that the fixing temperature received here is a fixing temperature necessary for fixing the fourth page after the page currently under fixing.

In step S724, the fixing temperature control unit 319 determines, as a control target page, the page of the maximum temperature from the already notified applied toner amount information of the four subsequent pages.

In step S725, the fixing temperature control unit 319 controls the temperature of the fixing unit 320 in consideration of the current fixing temperature and the fixing temperature of the control target page determined in step S724. More specifically, the temperature of the fixing unit 320 is raised as needed to make it reach the target temperature until execution of printing (execution of fixing) of the control target page. On the other hand, if the fixing temperature can be lowered to the target temperature, control is performed to lower the temperature.

In step S726, the CPU 315 determines whether the page ends. If the page does not end, processing from step S723 is repeated.

Figure 8:
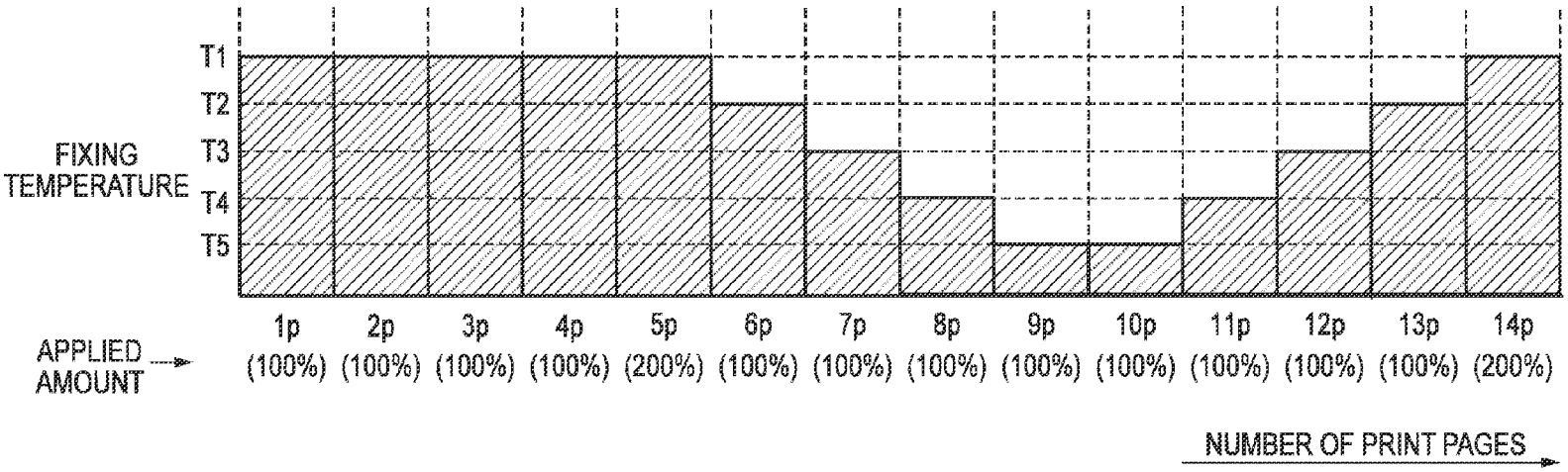
FIG. 8 is a graph showing an example of fixing temperature control at the time of printing of the image forming apparatus.

FIG. 8 is a graph showing an example of fixing temperature control at the time of printing of the image forming apparatus 101. The abscissa represents the number of pages to be printed, and the ordinate represents the fixing temperature when fixing the page. Note that the amount of applied toner of each page is shown under the number of pages. FIG. 8 shows an example in which data of 14 pages are received, the amounts of applied toner of the fifth page and the 14th page are 200%, and the amounts of applied toner of the remaining pages are 100%. Note that in the image forming apparatus 101, the relationship between the amount of applied toner and the minimum temperature necessary for fixing is the same as shown in FIG. 5. That is, the temperature necessary for fixing an image whose amount of applied toner is 200% is T1. The temperature necessary for fixing an image whose amount of applied toner is 100% is T5 (T5<T1).

As described above, for the first to fourth pages, fixing is performed at the maximum temperature T1 without fixing temperature control on a page basis so as to prevent the productivity from lowering. Since the fixing temperature control is performed from the fifth page, the amount of applied toner of the fifth page is detected during fixing of the first page.

When fixing the fifth page, the amount of applied toner of the fourth page after, that is, the ninth page is detected, and the minimum temperature necessary for fixing is notified to the fixing temperature control unit 319. In this case, T5 is notified as the target temperature. When fixing the fifth page, applied toner amount detection has been completed for image data of four pages ahead, that is, up to the ninth page. All the amounts of applied toner of the data of the sixth to ninth pages are 100%, and the target temperature is T5. For this reason, it is determined that the fixing temperature can be lowered from the current temperature T1. The fixing temperature control unit 319 controls to lower the temperature of the fixing unit 320 from the fixing processing of the sixth page.

On the other hand, when fixing the 10th page, the amount of applied toner of the 14th page is determined, and the minimum temperature capable of fixing is notified to the fixing temperature control unit 319. The amount of applied toner of the 14th page is 200%, and the fixing temperature needs to be T1 to print the 14th page. To attain the temperature T1 for the 14th page, the temperature needs to be raised from the 11th page. The fixing temperature control unit 319 controls to raise the temperature of the fixing unit 320 from the fixing processing of the 11th page.

With the above-described control, it is possible to perform temperature control of the fixing unit 320 according to the amount of applied toner without lowering the productivity and reduce the power consumption.

<Minimum Fixing Temperature Calculation Control>

Figure 9:
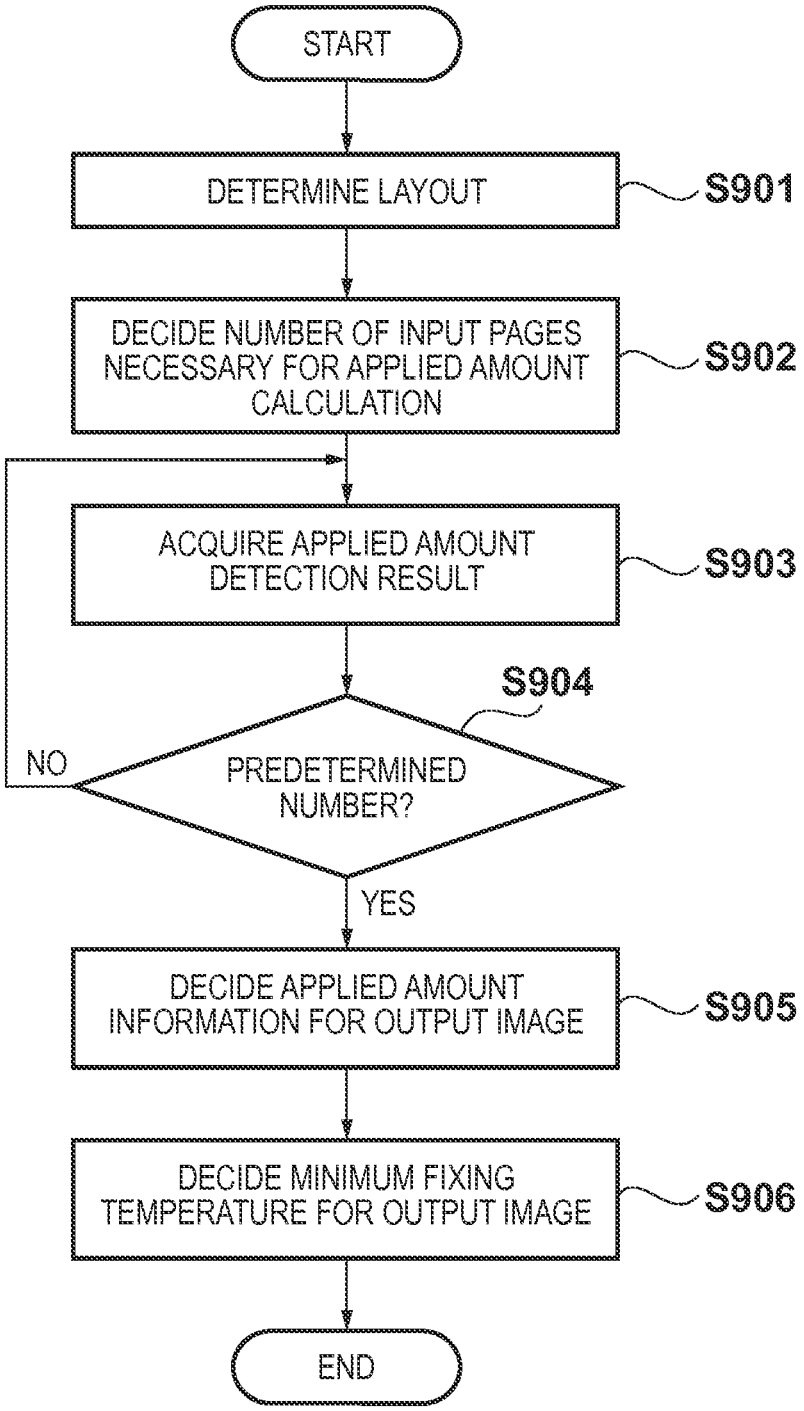
FIG. 9 is a flowchart showing fixing temperature control of the image forming apparatus.

FIG. 9 is a flowchart showing details of fixing temperature calculation control (step S703) of the image forming apparatus 101. The flowchart of FIG. 9 is executed under the control of the CPU 304.

In step S901, the CPU 304 determines what kind of layout is used for image formation of images to be printed. More specifically, the CPU 304 determines how many pages of input images are to be fitted in the image of one page of a printing medium when finally printing the image of one page on the printing medium (printing sheet) such as a paper sheet. For example, the CPU 304 determines whether to output the input image of one page directly as the image of one page or whether to do processing of fitting a plurality of images in one page by page aggregation or the like. This determination is done by, for example, detecting a designation of 4-in-1 printing in layout information included in a print job.

In step S902, the CPU 304 determines the number of pages of input images whose applied amount detection results should be referred to determine the minimum fixing temperature of a page to be finally output based on the result of determination in step S901. For example, if the result of determination in step S901 is 4-in-1 printing, the applied amount detection results of input images of four pages are determined as necessary for calculating the minimum fixing temperature necessary for printing the image data to be finally output.

In step S903, the CPU 304 reads an applied toner amount detection result corresponding to an input image from the applied toner amount detection unit 311 and manages it.

In step S904, the CPU 304 determines whether the number of images has reached the number determined in step S902. If the number of images has not reached the determined number, the process returns to step S903 to acquire an applied amount detection result of the next input image. If the number of images has reached the determined number in step S904, the process advances to step S905.

In step S905, the CPU 304 determines, as the applied toner amount information of the image to be finally output, the applied amount result of the input page having the largest amount of applied toner out of the applied amount detection results of the input images read and managed in step S903.

In step S906, the CPU 304 calculates the minimum temperature necessary for fixing the image to be output based on the applied toner amount information determined in step S905. The calculation method is the same as that described with reference to FIG. 5.

Figure 10:
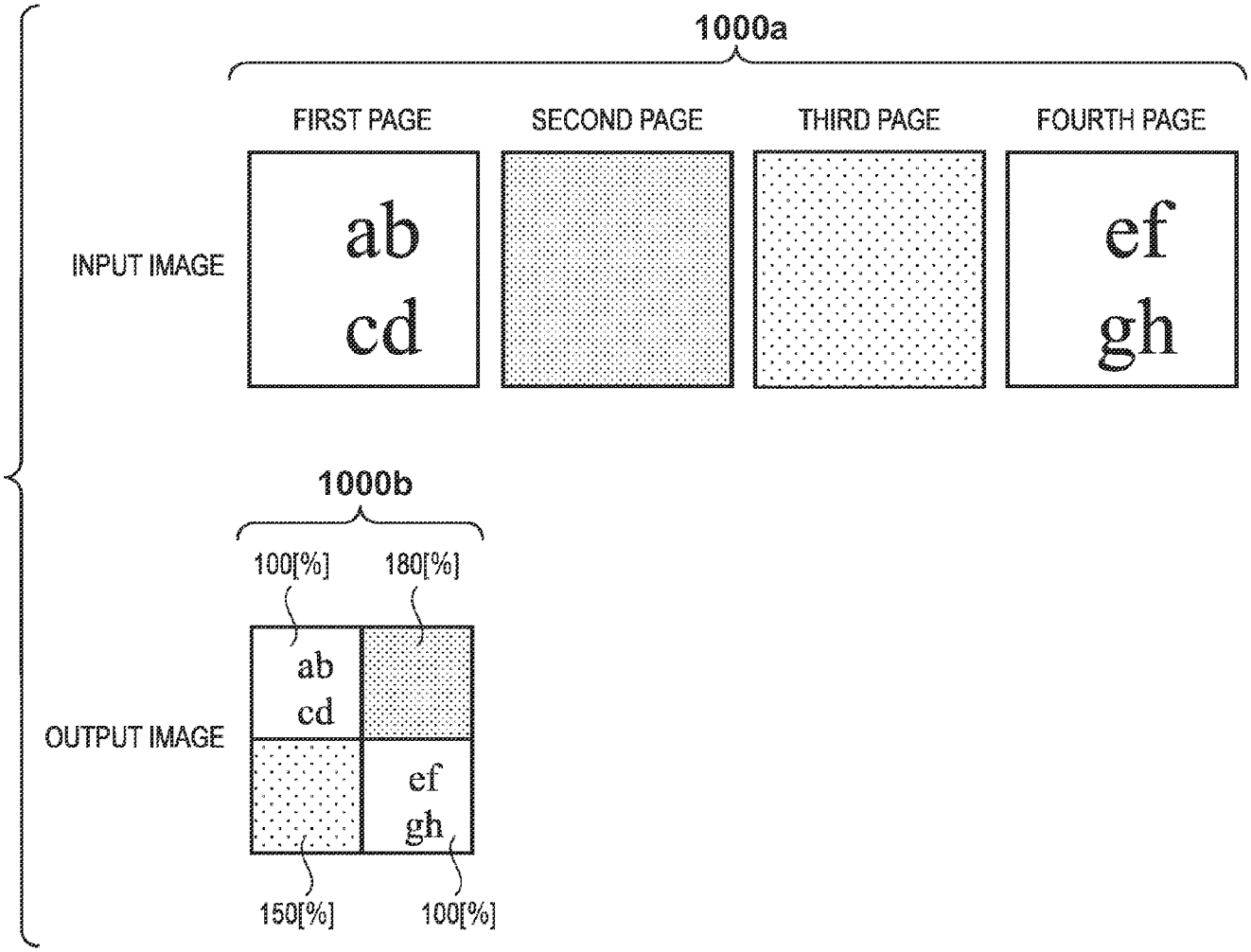
FIG. 10 is a conceptual view of output image data generation and an applied amount information calculation method.

FIG. 10 is a conceptual view of output image data generation and an applied amount information calculation method. In the following description, 4-in-1 printing of reducing each of the input images of four pages to a ¼ area, laying out them into one output image, and outputting it will be exemplified.

An input image 1000*a* indicates four input images generated in FIG. 6 (step S601) and to be 4-in-1-printed on one printing medium. An output image 1000*b* indicates one output image spooled in the RAM 306 in FIG. 6 (step S606) and having undergone a layout operation. The input images of the first to fourth pages of the input image 1000*a* are sequentially generated and laid out, and halftone processing is executed, thereby generating an output image represented by the output image 1000*b*.

At the same time as the output image generation, applied amount detection for each input image is performed in step S605. On the other hand, to calculate the fixing temperature for the output image, the CPU 304 executes fixing temperature control shown in FIG. 7A and fixing temperature calculation control shown in FIG. 9. By the fixing temperature calculation control shown in FIG. 9, 4-in-1 page aggregation processing is performed here. Hence, the CPU 304 acquires and manages the applied toner amount detection result of each page for the four input images represented by the input image 1000*a*. The applied toner amount detection results of the pages are shown by the output image 1000*b*. The applied toner amount detection result of the input image of the first page is 100 [%]. Similarly, the applied toner amount detection result is 180 [%] for the second page, 150 [%] for the third page, and 100 [%] for the fourth page. In FIG. 9 (step S905), the CPU 304 determines 180 [%] of the second page having the largest amount of applied toner out of the four pages as the amount of applied toner corresponding to the output image. In FIG. 9 (step S906), the CPU 304 calculates and determines the fixing temperature for the output image by the calculation method shown in FIG. 5.

As described above, according to the first embodiment, it is possible to appropriately adjust the fixing temperature according to the amount of applied toner. Especially when performing page aggregation, the fixing temperature can be adjusted more appropriately by using the maximum value of the amounts of applied toner of a plurality of input images as the amount of applied toner of an output image. By the control, power consumption can further be reduced while guaranteeing the image of image data to be output.

Second Embodiment

In the second embodiment, a method of determining an amount of applied toner in consideration of double-sided printing will be described. Fixing temperature calculation control of the image forming apparatus 101 is almost the same as in the first embodiment (FIG. 9), and only different portions will be explained.

In step S901, a CPU 304 determines what kind of layout is used for image formation of images to be printed. In this case, layout determination includes determining whether to perform double-sided printing of printing both surfaces of one printing medium.

In step S902, the CPU 304 determines the number of pages of input images whose applied amount detection results should be referred to determine the minimum fixing temperature of a page to be finally output. Unlike the first embodiment, it is determined to refer to the number of pages of input images necessary for generating output images for the obverse surface and the reverse surface.

For example, in 1-in-1 double-sided printing, the applied amount detection results of input images of a total of two pages (one page on the obverse surface and one page on the reverse surface) are determined as necessary for generating the output images. In 4-in-1 double-sided printing, the applied amount detection results of input images of a total of eight pages (four pages on the obverse surface and four pages on the reverse surface) are determined as necessary for generating the output images. As for the procedures of steps S903 and S904, the same processes as in the first embodiment are executed.

In step S905, the CPU 304 determines, as the applied toner amount information of the images on the obverse surface and the reverse surface to be finally output, the applied amount of an input page having the largest applied amount out of the applied amount detection results of the input images read and managed in step S903.

In step S906, the CPU 304 calculates the minimum temperature necessary for fixing the images on the obverse surface and the reverse surface to be output based on the applied toner amount information determined in step S905. That is, at the time of double-sided printing, control is performed to set the same fixing temperature for the obverse surface and the reverse surface of a single printing medium.

By the above-described control, the image forming apparatus having a short switching time between the obverse surface and the reverse surface of a paper sheet can perform print output at a higher speed while reducing power consumption. That is, it is possible to perform fixing processing for the reverse surface immediately after fixing processing for the obverse surface by controlling not to cause a change in the fixing temperature between the obverse surface and the reverse surface.

Third Embodiment

Figure 11:
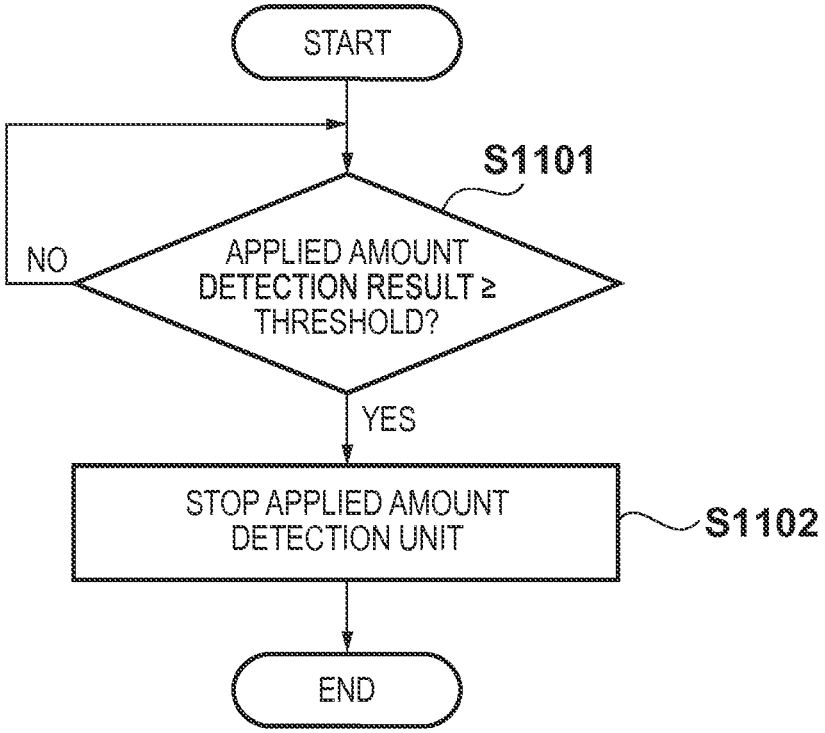
FIG. 11 is a flowchart of power consumption reduction control of an applied amount detection unit.

In the third embodiment, power consumption reduction control of an applied amount detection unit 311 will be described. FIG. 11 is a flowchart of power consumption reduction control of the applied amount detection unit 311. More specifically, this processing is executed between step S903 and step S904 of FIG. 9.

In step S1101, a CPU 304 determines whether an applied amount detection result detected by an applied amount detection unit 311 exceeds a predetermined threshold. Setting of the predetermined threshold will be described later. If the applied amount detection result does not exceed the threshold, the process remains in step S1101. If the applied amount detection result exceeds the threshold, the process advances to step S1102. In this case, the applied amount detection unit 311 is assumed to be configured to detect the amount of applied toner in an order designated in advance, for example, in the order of page.

In step S1102, the CPU 304 stops processing of the applied amount detection unit 311. Stopping processing here indicates controlling to stop the operation of the applied amount detection unit 311, and is implemented by stopping a clock signal input to the applied amount detection unit 311.

The above-described predetermined threshold corresponds to, for example, the amount of applied toner of 200 [%] in FIG. 5. That is, in step S1101, the CPU 304 determines whether the maximum fixing temperature controllable by the fixing unit 320 is necessary. For example, assume that the applied toner amount detection result of the second page of an input image is 200 [%] when generating an output image in 4-in-1 layout by page aggregation. In this case, the amounts of applied toner of the subsequent third and fourth pages need not be detected, and the minimum fixing temperature for the output image can immediately be determined as T1.

When control to omit applied toner amount detection is performed, as described above, unnecessary detection in the applied amount detection unit 311 can be reduced. This can implement further power consumption reduction.

In the first, second, and third embodiments, toner has been exemplified as a color material to be fixed. However, ink may be used.

Other Embodiments

Embodiments of the present invention can also be realized by a computer of a system or apparatus that reads out and executes computer executable instructions recorded on a storage medium (e.g., non-transitory computer-readable storage medium) to perform the functions of one or more of the above-described embodiment(s) of the present invention, and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-188719, filed Sep. 11, 2013, which is hereby incorporated by reference herein in its entirety.

What is claimed is:

1. An image forming apparatus for controlling a temperature of a fixing unit configured to fix a color material on a printing sheet, comprising:

an acquisition unit configured to acquire the color material amount of each page of image data of a plurality of pages;

a setting determination unit configured to determine whether a setting for printing image data of the plurality of pages on a printing sheet has been performed;

a one-color-material-amount determination unit configured to determine one color material amount out of a plurality of color material amounts acquired by said acquisition unit upon determining, as a result of determination of said setting determination unit, that the setting for printing image data of the plurality of pages on one printing sheet has been performed; and a control unit configured to control the temperature of the fixing unit using a fixing temperature corresponding to the color material amount determined by said one-color-material-amount determination unit.

2. The apparatus according to claim 1, wherein said one-color-material-amount determination unit determines a maximum color material amount out of the plurality of color material amounts.

3. The apparatus according to claim 1, wherein said setting determination unit determines, based on layout information input together with the image data of the plurality of pages, whether the setting for printing the image data of the plurality of pages on one printing sheet has been performed.

4. The apparatus according to claim 1, wherein said setting determination unit determines whether the setting for printing the image data of the plurality of pages on one surface of one printing sheet has been performed.

5. The apparatus according to claim 1, wherein said setting determination unit determines whether the setting for printing the image data of the plurality of pages on both surfaces of one printing sheet has been performed.

6. The apparatus according to claim 1, wherein said acquisition unit sequentially acquires the color material amounts for the image data of the plurality of pages, and if a color material amount not less than a predetermined amount is acquired for one of the image data of the plurality of pages, said acquisition unit does not perform processing of acquiring the color material amount for image data whose color material amount has not been acquired yet.

7. A method of controlling an image forming apparatus for controlling a temperature of a fixing unit configured to fix a color material on a printing sheet, comprising:

acquiring the color material amount of each page of image data of a plurality of pages;

determining in a first determining step whether a setting for printing image data of the plurality of pages on a printing sheet has been performed;

determining in a second determining step one color material amount out of a plurality of color material amounts acquired in the acquiring step upon determining, as a result of determination in the first determining step, that the setting for printing image data of the plurality of pages on one printing sheet has been performed; and controlling the temperature of the fixing unit using a fixing temperature corresponding to the color material amount determined in the second dtermining step.

8. A non-transitory computer-readable recording medium storing a program that causes a computer to function as each of the units of the image forming apparatus according to claim 1.

* * * * *